United States Patent [19]

Henry

[11] 4,450,509

[45] May 22, 1984

[54] LANTERNS FOR AREA LIGHTING

[75] Inventor: Ivor C. Henry, Enfield, England

[73] Assignee: Thorn Emi plc, London, England

[21] Appl. No.: 408,885

[22] Filed: Aug. 17, 1982

[51] Int. Cl.[3] ..... F21S 5/00

[52] U.S. Cl. ..... 362/216; 362/223; 362/263; 362/267; 362/309; 362/310; 362/311; 362/333; 362/337; 362/339; 362/340; 362/375

[58] Field of Search ..... 362/216, 223, 263, 267, 362/309, 310, 311, 333, 337, 339, 340, 375

[56] References Cited

U.S. PATENT DOCUMENTS

| | | | |
|---|---|---|---|
| 2,195,672 | 4/1940 | Gerrells | 362/339 |
| 3,249,752 | 5/1966 | Odle | 362/339 |
| 3,340,393 | 9/1967 | Franck et al. | 362/309 |
| 3,398,273 | 8/1968 | Rex et al. | 362/309 |
| 3,735,124 | 5/1973 | Stahlhut | 362/333 |
| 4,368,504 | 1/1983 | Sato et al. | 362/339 |

FOREIGN PATENT DOCUMENTS

| | | |
|---|---|---|
| 1049236 | 11/1966 | United Kingdom . |
| 1302603 | 1/1973 | United Kingdom . |
| 1340645 | 12/1973 | United Kingdom . |
| 1365507 | 9/1974 | United Kingdom . |

*Primary Examiner*—Stephen J. Lechert, Jr.

*Attorney, Agent, or Firm*—Fleit, Jacobson, Cohn & Price

[57] ABSTRACT

The invention provides a lantern for an area light, particularly one having a cut-off light distribution. A central area of a transparent or transluscent bowl of the lantern has in alternation externally facing reflecting prisms and flats. There are sufficient flats to transmit at least one third of the vertical light and sufficient proportion of prisms to provide a completely flashed prism bank at the direction of peak intensity which is preferably 60°–65° from the vertical. The prism bank controls the vertical light, so that the intensity in a vertical 60° cone does not exceed 80% of peak intensity, more efficiently than internal prisms. The flats have the additional advantage of facilitating ease of cleaning.

19 Claims, 4 Drawing Figures

LANTERNS FOR AREA LIGHTING

The present invention relates to lanterns for area lighting and in particular for street lighting. It is the practice to light streets and other roadways with lights, now generally discharge lamps, mounted in part transparent or translucent housings, called lanterns, on suitable columns or other supports above a street to be illuminated. It will be appreciated that although this form of lighting is more commonly seen in streets it may be used in other circumstances perhaps to illuminate private premises both inside and out and for that reason it is generally described here as area lighting. All references herein to street lighting are to be taken to be applicable as appropriate to other forms of area lighting. Area lighting for streets is generally subject to strict regulations regarding, among other things, intensity and distribution of light. This results from the application, which is to illuminate the road surface as economically as possible. A road user at night sees objects on the road in silhouette against a bright road surface. To provide such illumination a road lantern is generally designed to project light up and down a road, towards and away from an observer. That light which is directed towards an observer produces glare because the observer's eyes see not only light reflected off the road but also direct light from the lantern. The direction and intensity of the light from a road lantern determines the glare and also the required spacing of lanterns for uniform lighting.

A typical specification for road lighting lanterns is BS.4533 Part 2 of which section 2.7 classifies group A lantern photometric performance into two categories. One category (cut-off distribution) provides better glare control and a lower beam in elevation than the other (semi-cut-off distribution). The cut-off distribution allows the beams to extend to an elevation of 65° with an intensity at 90° in elevation (in the vertical plane parallel to the street axis) of 15 cd/klm. The semi-cut-off allows the beam to extend to an elevation of 75° and the intensity at 90° in elevation to be 75 cd/klm. This intensity limit at 90° in elevation is an approximate measure of glare and, it can be seen, may be five times higher in semi-cut-off than in cut-off lanterns. In general it is 30% more expensive to illuminate a road with cut-off lanterns compared with semi-cut-off, since the cut-off distribution, having a lower beam angle, requires closer spacing for acceptable lighting uniformity.

A further requirement which applies to both distributions is that the maximum intensity within the cone from the downward vertical to an elevation of 30° should not exceed 80% of the peak intensity (or of the maximum within the beam). It is with compliance with this requirement that this invention is concerned.

It has been the practice to obtain the appropriate distributions by the choice of lantern design. A lantern generally includes two parts, a transparent or translucent bowl facing the surface to be illuminated, and an opaque canopy above, with the discharge tube or tubes mounted therein. The lantern may include reflectors and the bowl may include shaped surfaces to refract the light.

In general a cut-off distribution is obtained from a lantern including reflectors. In such as optical design, light is reflected off reflectors on both sides of the lamp to pass underneath and around the end of the lamp. This requires a relatively large lantern, to include the reflectors, compared with a refractor type of optical design in which light is emitted from the lantern through prism bands on either side of the lamp integral with the lantern bowl. However, since in general refractor optics produce more glare than reflector control, it has been usual to reserve refractor optics for semi-cut-off distributions.

It is an object of this invention to provide an improved optical design for area lighting lanterns for the control of intensity directed vertically downwards from the lamp, substantially within a 30° Cone. This is particularly useful for a cut-off distribution but is also applicable to semi-cut-off.

According to the invention there is provided a lantern, for and area light, including a transparent or translucent bowl whose exterior includes a substantially central area having, in alternation, regions acting as reflecting prisms to light passing therethrough and regions substantially perpendicular to the vertical axis of the lantern.

In order that the invention may be clearly understood and readily carried with effect it will now be described by way of example with reference to the accompanying drawings, if which:

Figure 4:
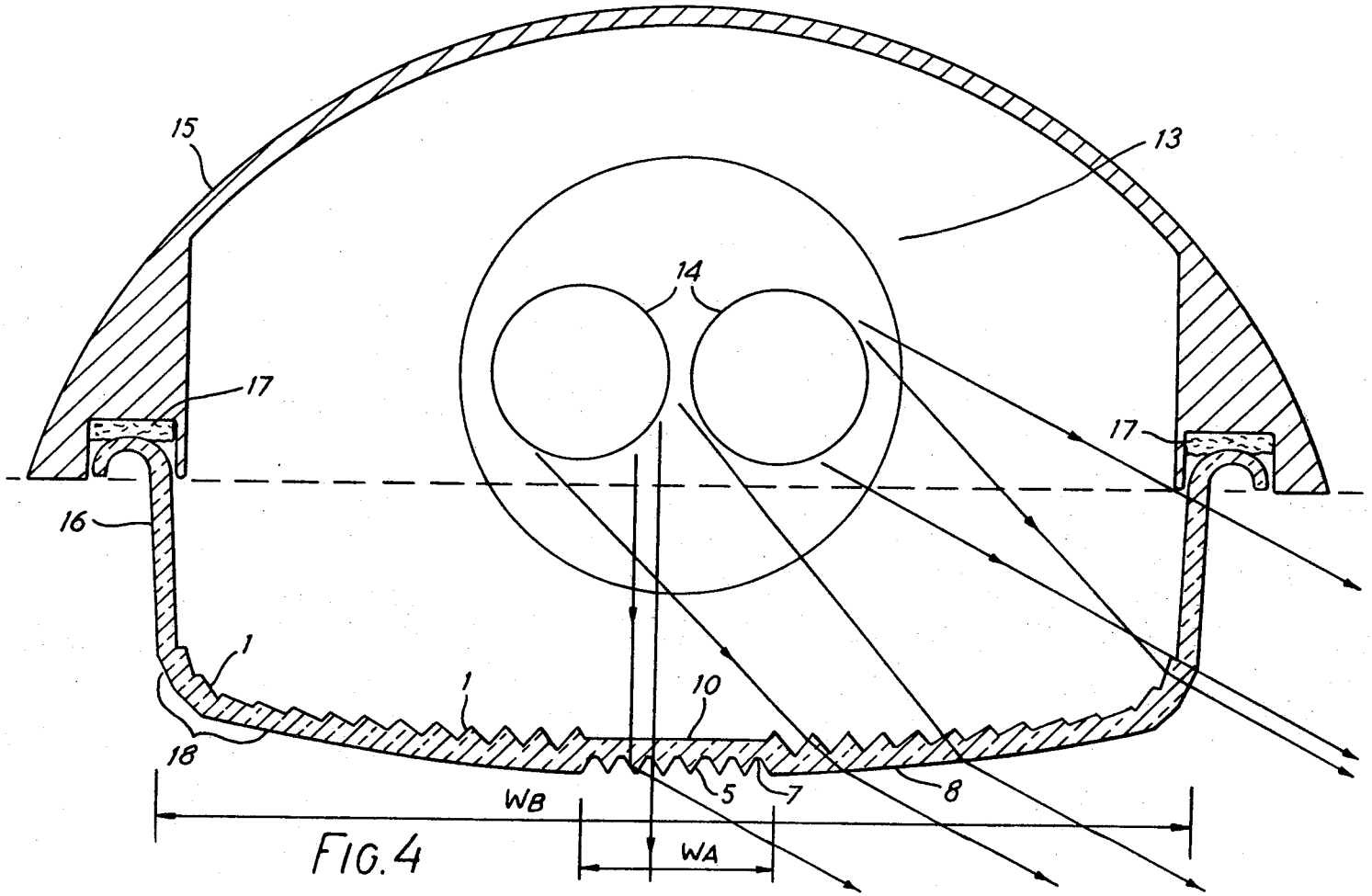
FIG. 4 shows a complete lantern in accordance with the invention.

FIG. 5*a* shows a fragmentary bottom plan view of the central region of the lantern of FIG. 4, FIG. 5*b* is a fragmentary cross-sectional elevation of the lantern of FIG. 4, and FIG. 6 shows, an enlarged scale, a fragmentary plan view of the central region of another embodiment of the lantern of FIG. 4 with the prisms in curved disposition.

This description of the invention will be in relation to a new design of lantern providing cut-off distribution by purely refractive optical design. It should be noted, however, that the optical design for control of the vertical light intensity is applicable both to cut-off designs using reflectors and semi-cut-off designs.

In general such lanterns are mounted to illuminate a surface directly there below. However the lanterns may be mounted in other positions. In this specification the words vertical and horizontal are considered to have that relationship to the lantern, however it is mounted, which they would have when the lamp is mounted conventionally above level ground with the vertical axis perpendicular to the illuminated surface.

Considering an existing arrangement giving semi-cut-off distribution for a typical discharge lamp, a 135 Watt SOX (low pressure sodium) lamp, the lantern comprises a white glass reinforced plastic (GRP) canopy with a clear prismatic bowl below. The existing semi-cut-off version has a shallow canopy with a semi-circular cross-section of bowl. In comparison the cut-off development has a deeper canopy with a shallower bowl having a relatively flat prismatic base and clear and nearly vertical sides. Since refractor only optics are used the overall size is smaller than for conventional reflector designs, and has lower material costs.

The bowl is designed to be as shallow as possible to keep the projected area from the side in the horizontal direction to a minimum. This helps to reduce horizontal light intensity due to light scattered in the bowl material. In conjunction with this the bowl is expected to have sufficient flashed projected area (defined as an area projecting an image of the light source) in the direction of a peak, which should produce a minimum intensity of 200 cd/1000 lamp lumens in a region between 60° and 65° from the downward vertical.

As mentioned hereinbefore, an important requirement with which this invention is concerned is that of limiting the downward intensity to less than 80% of the peak intensity.

In achieving this requirement problems arise because of the flat and shallow nature of the bowl of which the projected area is significantly greater in the 0° to 30° region than when viewed from 65°.

Figure 1:
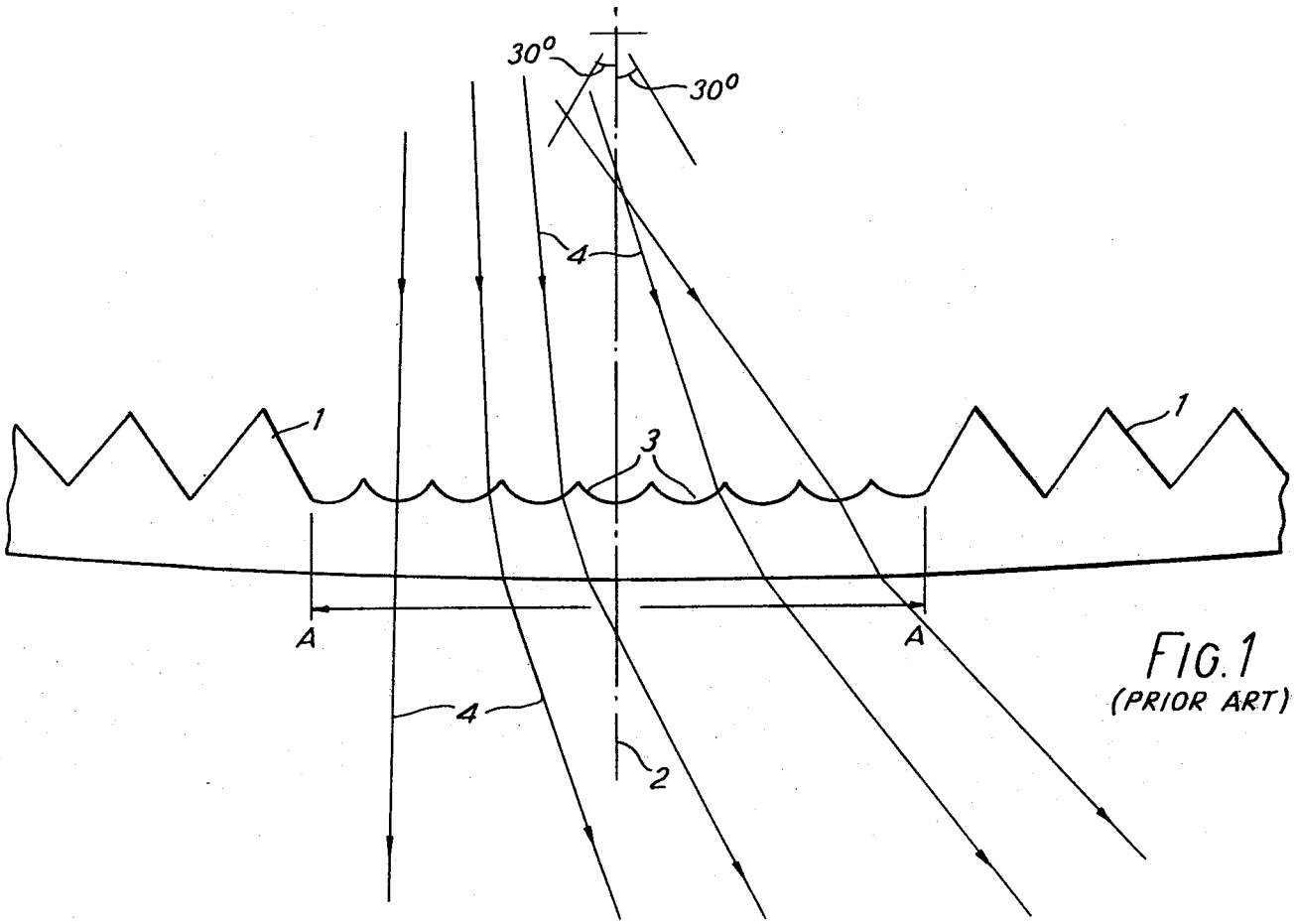
FIG. 1 (PRIOR ART)
FIG. 1 shows the central region of the bowl of a prior art lantern.

FIG. 1 shows in cross-section perpendicular to the principal axis of the lamp, the centre part of the bowl of a prior art cut-off lantern. Over most of the bottom of the bowl there are formed internally facing prisms 1 which extend substantially for the complete length of the bowl. The light falling on such prisms becomes increasingly less effective when it strikes them from closer to the vertical axis 2. This axis, which is usually vertical in relation to the street surface, is in fact the central plane of symmetry of the lantern but will be called the vertical axis herein. As a result there is too much light in the downward direction compared with that in the direction of peak intensity.

To corret this to some extent, in a central region AA the prisms are replaced by semi-circular grooves 3 which scatter rather than controlling the light from the lamp. The aim is then to scatter a sufficient amount of light out of the 0° to 30° cone. Some light paths 4, from the lamp, are shown to clarify the optics of the designs.

Figure 2:
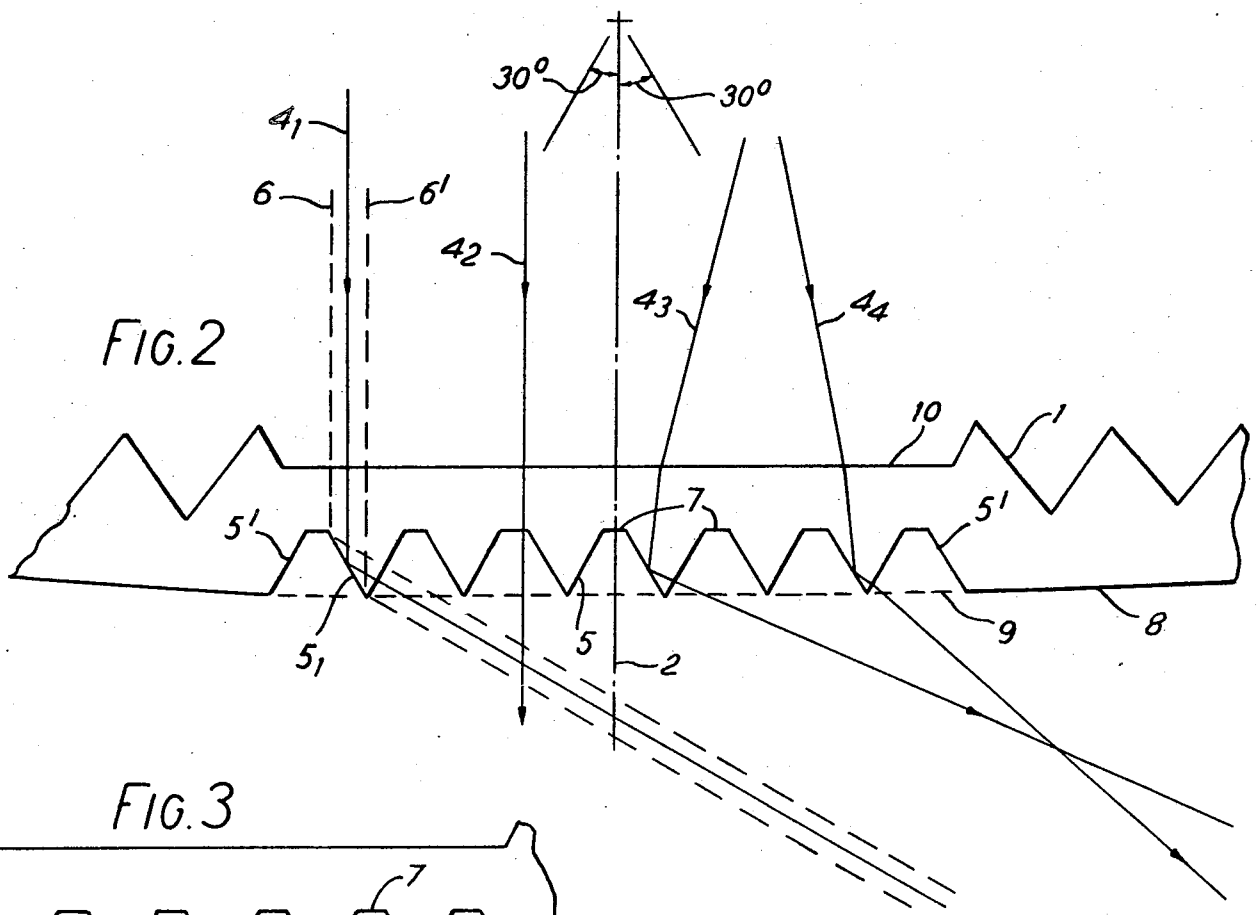
FIG. 2 shows the same region of a lantern in accordance with the invention.

It is, however, found that this is still not as effective as would be desired and FIG. 2 shows the same cross-section as FIG. 1 but incorporating the improved optical design of this invention. Prisms 1 are provided as before but in the centre the inside grooves 3 have been replaced by prisms 5 on the outside of the bowl. These prisms 5 are reflecting prisms since a light ray entering a prism will be internally reflected, as well as being refracted before leaving the prism. This can be seen with a ray between limits 6 and $6^1$, of which $4_1$ typical, which is reflected in prism $5_1$ as shown. In prisms 1 in contrast there is only refraction. Between each prism 5, including the terminating half prisms $5^1$, there is a flat region 7. Some light, such as that of ray $4_2$ passes straight through the flats 7, giving a vertical beam, while those, such as $4_3$ and $4_4$, passing through the prisms 5 are largely reflected out of the vertical beams.

The ratio of prisms 5 to flats 7 in area may be varied to adjust the intensity of the vertical beam but the prisms 5 should be sufficiently closely spaced to give the appearance of a completely flashed prism bank in the direction of the main beam (that is, at the peak). It is preferred that ⅓ of the vertical light beam passes through flats 7. An additional advantage resulting from the presence of the flats 7 is in ease of cleaning of the bowl exterior.

Certain considerations should preferably be met in the design of these prisms 5. The external surface 8 of the bowl is substantially flat but is in this example a shallow curve. If a chord to this curve is as shown at 9, across the prisms 5, it is preferred that the tops of the prisms do not protrude beyond this chord so as to reduce the risk of spill light being refracted out at 90°. The inner surface 10 above prisms 5 is also preferred to be parallel to chord 9 or at least to not deviate from parallelism by more than about 5°. It may also be curved provided the maximum deviation from the side of the arc to the bottom does not exceed about 5°.

Figure 3:
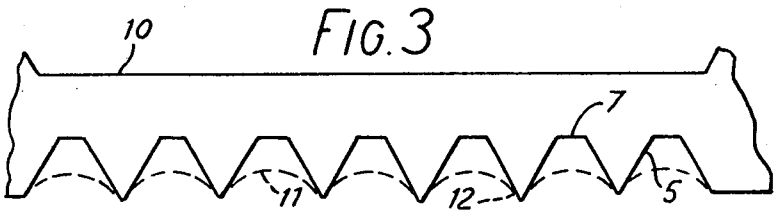
FIG. 3 shows an alternative form of the prisms 5 of FIG. 2.

Although triangular prisms with intervening flats have been illustrated in FIG. 2 it will be understood that the invention may be implemented, with some loss of performance, by shapes which approximate to that ideal. For example FIG. 3 illustrates how the prisms may be approximated by grooves or flutes 11 with concavities outward facing. The top most parts of these tend to act as flats 7 while the regions of the cusps 12 tend to act as reflecting prisms. Such grooves do, however, tend to scatter the light as opposed to controlling it and are not preferred.

FIG. 4 shows in cross-section a complete cut-off lantern in accordance with the invention. A 135 watt SOX lamp 13 having a U-shaped discharge tube 14 is enclosed in the lantern which comprises a canopy 15 and bowl 16. The two are clipped together by conventional means (not shown) and sealed with a sealing pad 17 to exclude moisture. Other features are identified by the same reference numerals as in the earlier Figures. The lamp illustrated is 775 mm long 67 mm dia. The length of the lantern (perpendicular to the Figure) is generally slightly longer than the tube in use. All dimensions clearly may vary with the application and powers of the lamp. It is preferred that the prisms 5 extend for substantially the full length of the lantern. They may, however, merely extend only over a sufficient region to achieve the desired 80% intensity. The remainder of the central region may be provided with internal grooves 3 as shown in FIG. 1.

Although the ratio of the width $W_A$ of the exterior prism region to the width $W_B$ of the total lantern, should be adjusted for best results it is in practice a ratio which varies for different designs and lamps. In general it should be adjusted so that the prisms 5 have a sufficient interception of the 0°–30° beam but varies with the application.

The invention has been described in terms of a lantern for a low pressure sodium light having a linear tube to which the external reflecting prisms are parellel as shown in FIGS. 5*a* and 5*b*. It will be appreciated that it is applicable to other forms of lamp. For example mercury lamps and some high pressure sodium (SON) lamps generally have elliptical outer envelopes. These are often used with more rounded shapes of bowl. In application of this invention that bowl shape could be used with the external reflecting prisms in curved disposition generally concentric around the lamp for example as shown in underplan in FIG. 6. Other shapes can be devised to suit other lamp configurations.

I claim:

1. A lantern, for an area light, including a transparent or translucent bowl whose exterior includes a substantially central area having, in alternation, regions acting as reflecting prisms to light passing therethrough and substantially flat regions substantially perpendicular to the vertical axis of the lantern.

2. A lantern according to claim 1 in which the regions acting as reflecting prisms are sufficiently closely spaced to provide a completely flashed prism bank when viewed from the direction of peak intensity of the lamp.

3. A lantern according to claim 2 in which the said direction is between 60° and 65° from the said vertical axis.

4. A lantern according to any one of claims 1 to 3 in which the regions acting as reflecting prisms are sufficiently spaced to allow at least one third of light travelling substantially parallel to the vertical axis to pass through said perpendicular regions.

5. A lantern according to any one of claims 1 to 3 in which the external surface of the bowl has a base part, including said central area, which is substantially flat outside said central area and in which the internal surface of the central area is substantially parallel to said flat part.

6. A lantern according to any one of claims 1 to 3 in which the external surface of the bowl has a base part, including said central area, which is convex outside said central area.

7. A lantern according to claim 6 in which the tips of said regions acting as reflecting prisms do not protrude beyond a chord to said convex surface between the extremes of the central area.

8. A lantern according to claim 7 in which the inside surface of said central area does not deviate by more than 5° from parallelism to said chord.

9. A lantern according to any one of claims 1 to 3 in which the regions acting as reflecting prisms are substantially triangular prisms.

10. A lantern according to any of claims 1 to 3 in which the external surface of said central area is formed with outwardly facing concave flutes of which the cusps are substantially perpendicular to said vertical axis.

11. A lantern according to any one of claims 1 to 3 in which said regions acting as reflecting prisms are linear and disposed substantially parallel to each other.

12. A lantern according to any one of claims 1 to 3 in which said regions acting as reflecting prisms are curved and disposed around the centre of said central area.

13. An area light having a lantern according to any one of claims 1 to 3.

14. An area light according to claim 13 arranged to have a cut-off light distribution.

15. A lantern for an area light, the lantern including a transparent or translucent bowl having a substantially central area which is substantially flat on the interior on the bowl and which on the outside is formed as a recessed region, the bowl also including a plurality of external reflecting prisms within said recessed region and, between each two of said prisms, a substantially flat region, wherein the total area of the flat regions is at least one third of the area of the recessed region.

16. A street light including a lantern comprising a position for mounting a lamp, a canopy disposed to be above the lamp position when the light is in use and a transparent or translucent bowl detachably sealed to the canopy to enclose the lamp position, the bowl including a central region, disposed to be beneath the lamp position when the light is in use, being substantially flat on the interior of the bowl and comprising on the exterior of the bowl a plurality of recessed reflecting prisms spaced by substantially flat regions.

17. An area light including: a U-shaped low pressure sodium discharge tube having two parallel arms; and a lantern comprising a canopy and a bowl of translucent or transparent material detachably sealed to the canopy to enclose the discharge tube; wherein the bowl includes a central region comprising a plurality of elongated recessed external reflecting prisms spaced by a plurality of substantially flat regions, the prisms being disposed substantially parallel to the arms of the discharge tube.

18. An area light including a discharge lamp and a lantern comprising (a) a canopy and, (b) a bowl of translucent or transparent material detachably sealed to the canopy to enclose the discharge tube;

wherein the bowl includes a central region, being flat on the interior thereof and being recessed on the exterior thereof and further includes a plurality of external reflecting prisms formed on the recessed exterior of the central region and spaced by substantially flat areas so that intensity of light emitted from the lamp when in use in a cone, extending to an angle of 30% from the perpendicular to the central region, does not exceed 80% of the lamp peak directional intensity.

19. A lantern for an area light, the lantern having a transparent or translucent bowl having a generally planar or shallowly curved part generally perpendicular to a central plane of symmetry thereof, said part including:

(a) a substantially central area which is substantially flat on the interior of the bowl and which on the outside is formed as a recessed region having therein a plurality of external reflecting prisms spaced by substantially flat regions; and (b) outside the central area a further region having a plurality of prisms on the interior of the bowl and being substantially flat on the exterior of the bowl;

wherein the recessed region is recessed sufficiently for the external prisms not substantially to protrude beyond the exterpolation of the line of the flat external surface of the further region across the recessed region, or a chord thereto if said line is a shallow curve, and the said flat interior of said central region does not deviate by more than 5° from parallelism with said exterpolation or said chord.

* * * * *